US011176884B2

(12) United States Patent
Chang et al.

(10) Patent No.: US 11,176,884 B2
(45) Date of Patent: Nov. 16, 2021

(54) OLED PIXEL DRIVING CIRCUIT, ARRAY SUBSTRATE AND DISPLAY DEVICE

(71) Applicant: SHENZHEN CHINA STAR OPTOELECTRONICS SEMICONDUCTOR DISPLAY TECHNOLOGY CO., LTD., Guangdong (CN)

(72) Inventors: Bobiao Chang, Guangdong (CN); Xiaolong Chen, Guangdong (CN); Yi-chien Wen, Guangdong (CN)

(73) Assignee: Shenzhen Chins Star Optoelectronics Semiconductor Display Technology Co., Ltd., Guangdong (CN)

( * ) Notice: Subject to any disclaimer, the term of this patent is extended or adjusted under 35 U.S.C. 154(b) by 79 days.

(21) Appl. No.: 16/755,585

(22) PCT Filed: Nov. 23, 2017

(86) PCT No.: PCT/CN2017/112595
§ 371 (c)(1),
(2) Date: Apr. 12, 2020

(87) PCT Pub. No.: WO2019/090839
PCT Pub. Date: May 16, 2019

(65) Prior Publication Data

US 2020/0258447 A1 Aug. 13, 2020

(30) Foreign Application Priority Data

Nov. 7, 2017 (CN) ..... 201711096561.6

(51) Int. Cl.
*G09G 3/325* (2016.01)
*G09G 3/3291* (2016.01)
(Continued)

(52) U.S. Cl.
CPC ..... *G09G 3/325* (2013.01); *G09G 3/3266* (2013.01); *G09G 3/3291* (2013.01); *G09G 3/3659* (2013.01)

(58) Field of Classification Search
CPC .... G09G 3/325; G09G 3/3266; G09G 3/3291; G09G 3/3659; G09G 2310/0256;
(Continued)

(56) References Cited

U.S. PATENT DOCUMENTS 7,557,784 B2 * 7/2009 Kwak ..... G09G 3/3233
9,368,061 B2 * 6/2016 Kim ..... G09G 3/3225
(Continued)

*Primary Examiner* — Bryan Earles
(74) *Attorney, Agent, or Firm* — Mark M. Friedman

(57) ABSTRACT

OLED pixel driving circuit, array substrate and display device are provided. The pixel driving circuit comprises a driving control unit, a first light emitting unit and a second light emitting unit. Two OLEDs share one driving control unit, so the two OLEDs alternately emit light. In this way, light emitting time of the OLEDs is reduced, number of parasitic capacitors and data lines in a panel is reduced, and aperture ratio of the OLED device is increased; and OLEDs are enabled to be in reverse bias in a non-light emitting display frame, so that OLEDs do not have to be in a DC bias state for a long time, and thus, aging of the OLED device is slowed down. No other reverse bias voltage is connected externally, difficulty of tracing of the pixel circuit and crosstalk from a bias voltage line to other signal lines are reduced.

20 Claims, 3 Drawing Sheets

(51) Int. Cl.
*G09G 3/3266* (2016.01)
*G09G 3/36* (2006.01)

(58) Field of Classification Search
CPC ... G09G 2300/0819; G09G 2300/0842; G09G 2300/0861; G09G 2320/045; G09G 3/3233; G09G 2300/0804; G09G 3/3258
See application file for complete search history.

(56) References Cited

U.S. PATENT DOCUMENTS

| | | | | |
|---|---|---|---|---|
| 9,460,655 | B2 * | 10/2016 | Qing | G09G 3/3225 |
| 9,972,248 | B2 * | 5/2018 | Yang | G09G 3/3233 |
| 9,978,307 | B2 * | 5/2018 | Yang | G09G 3/3233 |
| 10,186,192 | B2 * | 1/2019 | Tong | G09G 3/3233 |
| 10,417,958 | B2 * | 9/2019 | Chung | G09G 3/3225 |
| 2006/0114193 | A1 * | 6/2006 | Kwak | G09G 3/3233 345/76 |

* cited by examiner

OLED PIXEL DRIVING CIRCUIT, ARRAY SUBSTRATE AND DISPLAY DEVICE

FIELD OF INVENTION

The present disclosure relates to the field of display technologies, and more particularly to an organic light emitting diode (OLED) pixel driving circuit, an array substrate, and a display device.

BACKGROUND OF INVENTION

Organic light emitting diodes (OLEDs) have many excellent characteristics such as wide color gamut, high contrast, and solid-state devices, so they are becoming more and more competitive in the field of display technology. Generally, a pixel array composed of electronic pixels is provided in a display area of an organic light emitting display, and each pixel unit includes a pixel driving circuit.

Traditional 2T1C architecture circuit means that the circuit includes two thin film transistors and a storage capacitor. The thin film transistor that functions as a switch connects a data voltage to a gate of a driving thin film transistor when it is in the on state, and stores the data voltage on the storage capacitor. This keeps the driving thin film transistor on. When an OLED is in a DC bias state for a long time, internal ions are polarized to form a built-in electric field. This causes a threshold voltage of the OLED to increase continuously, and luminous brightness of the OLED continues to decrease, and long-term light emission will shorten a life of the OLED and accelerate aging of the OLED.

In view of the foregoing defects, in an existing improvement scheme, the OLED can be placed in a reverse bias state in a display frame that does not emit light, and built-in electric field strength can be reduced. However, in this solution, each OLED device needs a corresponding data line. This doubles the data line routing in an OLED panel, resulting in a reduction in a panel aperture ratio. Moreover, each OLED corresponds to a driving thin film transistor and a storage capacitor, which doubles a number of storage capacitors in the panel, resulting in an increase in parasitic capacitance of the panel.

SUMMARY OF INVENTION

A technical problem mainly solved by the present invention is to provide an organic light emitting diode (OLED) pixel driving circuit, an array substrate, and a display device, which can reduce a number of parasitic capacitances and data lines in a panel and improve an aperture ratio of an OLED device.

To solve the above technical problem, a first technical solution adopted by the present invention is to provide an organic light emitting diode (OLED) pixel driving circuit, comprising: a driving control unit; a first light emitting unit; and a second light emitting unit;

wherein the driving control unit comprises a first switch, a second switch, and a storage capacitor; a control end of the second switch is connected to a scan line, a drain of the second switch is connected to a data line, a source of the second switch is connected to an end of the storage capacitor and a control end of the first switch, and another end of the storage capacitor and a drain of the first switch are connected to a first power source;

wherein a source of the first switch is connected to the first light emitting unit and the second light emitting unit, the first light emitting unit and the second light emitting unit are connected to a second power source, a control end of the first light emitting unit is connected to a first control signal, a control end of the second light emitting unit is connected to a second control signal, and the driving control unit, the first control signal, and the second control signal control the first light emitting unit and the second light emitting unit to alternately emit light.

To solve the above technical problem, a second technical solution adopted by the present invention is to provide an OLED display device, comprising: an OLED array substrate comprising a pixel driving circuit, wherein the pixel driving circuit comprises a driving control unit; a first light emitting unit; and a second light emitting unit;

wherein the driving control unit comprises a first switch, a second switch, and a storage capacitor; a control end of the second switch is connected to a scan line, a drain of the second switch is connected to a data line, a source of the second switch is connected to an end of the storage capacitor and a control end of the first switch, and another end of the storage capacitor and a drain of the first switch are connected to a first power source;

wherein a source of the first switch is connected to the first light emitting unit and the second light emitting unit, the first light emitting unit and the second light emitting unit are connected to a second power source, a control end of the first light emitting unit is connected to a first control signal, a control end of the second light emitting unit is connected to a second control signal, and the driving control unit, the first control signal, and the second control signal control the first light emitting unit and the second light emitting unit to alternately emit light.

To solve the above technical problem, a third technical solution adopted by the present invention is to provide an OLED display device, comprising: an OLED array substrate comprising a pixel driving circuit, wherein the pixel driving circuit comprises a driving control unit; a first light emitting unit; and a second light emitting unit;

wherein the driving control unit comprises a first switch, a second switch, and a storage capacitor; a control end of the second switch is connected to a scan line, a drain of the second switch is connected to a data line, a source of the second switch is connected to an end of the storage capacitor and a control end of the first switch, and another end of the storage capacitor and a drain of the first switch are connected to a first power source;

wherein a source of the first switch is connected to the first light emitting unit and the second light emitting unit, the first light emitting unit and the second light emitting unit are connected to a second power source, a control end of the first light emitting unit is connected to a first control signal, a control end of the second light emitting unit is connected to a second control signal, and the driving control unit, the first control signal, and the second control signal control the first light emitting unit and the second light emitting unit to alternately emit light.

Beneficial effects of the present invention are that: Different from the situation of the prior art, the present invention allows two OLEDs to share a driving thin film transistor, a storage capacitor, and a data line, so that the two OLEDs alternately emit light. In this way, the light emitting time of the OLEDs is reduced, the number of parasitic capacitors and data lines in a panel is reduced, and the aperture ratio of the OLED device is increased; and the OLEDs are enabled to be in reverse bias in a non-light emitting display frame, so that the OLEDs do not have to be in a DC bias state for a long time, and thus, the aging of the OLED device is slowed down. In addition, no other reverse bias voltage is connected externally, so the difficulty of tracing of the pixel circuit and the crosstalk from a bias voltage line to other signal lines are reduced.

DETAILED DESCRIPTION OF PREFERRED EMBODIMENTS

The technical solutions in the embodiments of the present invention will be clearly and completely described below with reference to the accompanying drawings in the embodiments of the present invention. Obviously, the described embodiments are only a part of the embodiments of the present invention, but not all the embodiments. Based on the embodiments of the present invention, all other embodiments obtained by a person of ordinary skill in the art without making creative efforts shall fall within the protection scope of the present invention.

Figure 1:
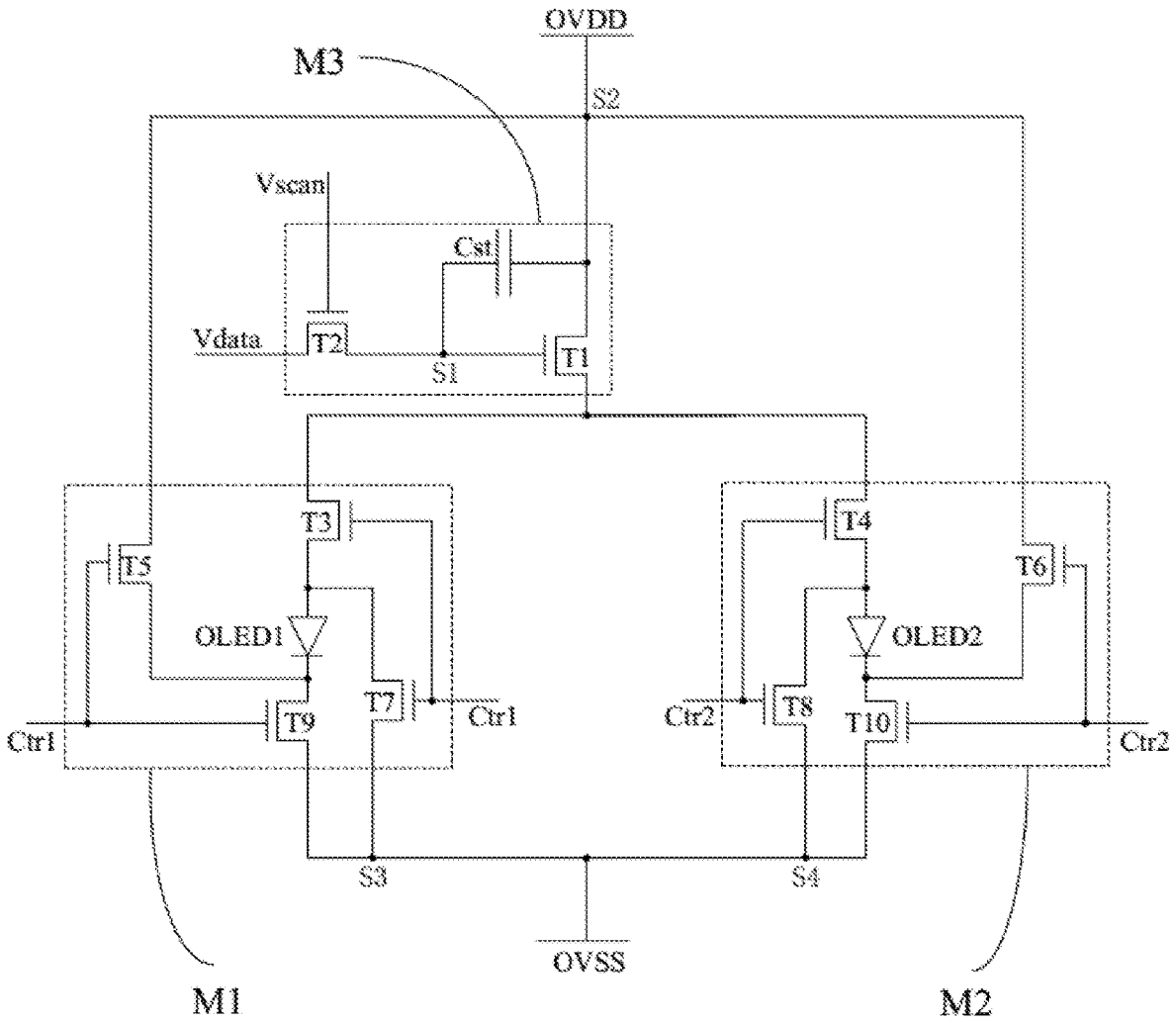
FIG. 1 is a schematic diagram of a specific structure of an OLED pixel driving circuit according to an embodiment of the present invention.

FIG. 1 is a schematic diagram of a specific structure of an OLED pixel driving circuit according to an embodiment of the present invention. The pixel driving circuit provided in this embodiment includes a driving control unit M3, a first light emitting unit M1, and a second light emitting unit M2. The driving control unit M3 includes a first switch T1, a second switch T2, and a storage capacitor Cst. A control end of the second switch T2 is connected to a scan line Vscan. A drain of the second switch T2 is connected to a data line Vdata. A source of the second switch T2 is connected to an end of the storage capacitor Cst and a control end of the first switch T1, respectively. Another end of the storage capacitor Cst and a drain of the first switch T1 are connected to a first power source OVDD. The first switch T1 is a driving thin film transistor in this embodiment. The second switch T2 is used to transmit a data signal Vdata to its source under control of a scan signal Vscan. The storage capacitor Cst is used to store a level between a source of the second switch T2 and the first power source OVDD. A source of the first switch T1 is connected to the first light emitting unit M1 and the second light emitting unit M2, respectively. The first light emitting unit M1 and the second light emitting unit M2 are connected to a second power source OVSS, respectively. A control end of the first light emitting unit M1 is connected to a first control signal Ctr1. A control end of the second light emitting unit is connected to a second control signal Ctr2.

Further, the first light emitting unit M1 in this embodiment specifically includes a third switch T3, a fifth switch T5, a seventh switch T7, a ninth switch T9, and a first light emitting diode OLED1. An anode of the first light emitting diode OLED1 is connected to a drain of the third switch T3 and a drain of the seventh switch T7. A cathode of the first light emitting diode OLED1 is connected to a source of the ninth switch T9 and a source of the fifth switch T5. A drain of the fifth switch T5 is connected to the first power source OVDD. A source of the seventh switch T7 and a drain of the ninth switch T9 are connected to the second power source OVSS. The second light emitting unit M2 specifically includes a fourth switch T4, a sixth switch T6, an eighth switch T8, a tenth switch T10, and a second light emitting diode OLED2. An anode of the second light emitting diode OLED2 is connected to a drain of the fourth switch T4 and a drain of the eighth switch T8. A cathode of the second light emitting diode OLED2 is connected to a source of the tenth switch T10 and a source of the sixth switch T6. A drain of the sixth switch T6 is connected to the first power source OVDD. A source of the eighth switch T8 and a drain of the tenth switch T10 are connected to the second power source OVSS.

The switches mentioned in the above embodiments include P-type and N-type transistor switches. Specifically, the first switch T1, the second switch T2, the fifth switch T5, the sixth switch T6, the seventh switch T7, and the eighth switch T8 are N-type transistor switches. The third switch T3, the fourth switch T4, the ninth switch T9, and the tenth switch T10 are P-type transistor switches. The P-type transistor switch is turned on when a control end thereof is low and turned off when the control end thereof is high. The N-type transistor switch is turned off when a control end thereof is low and turned on when the control end thereof is high.

Figure 2:
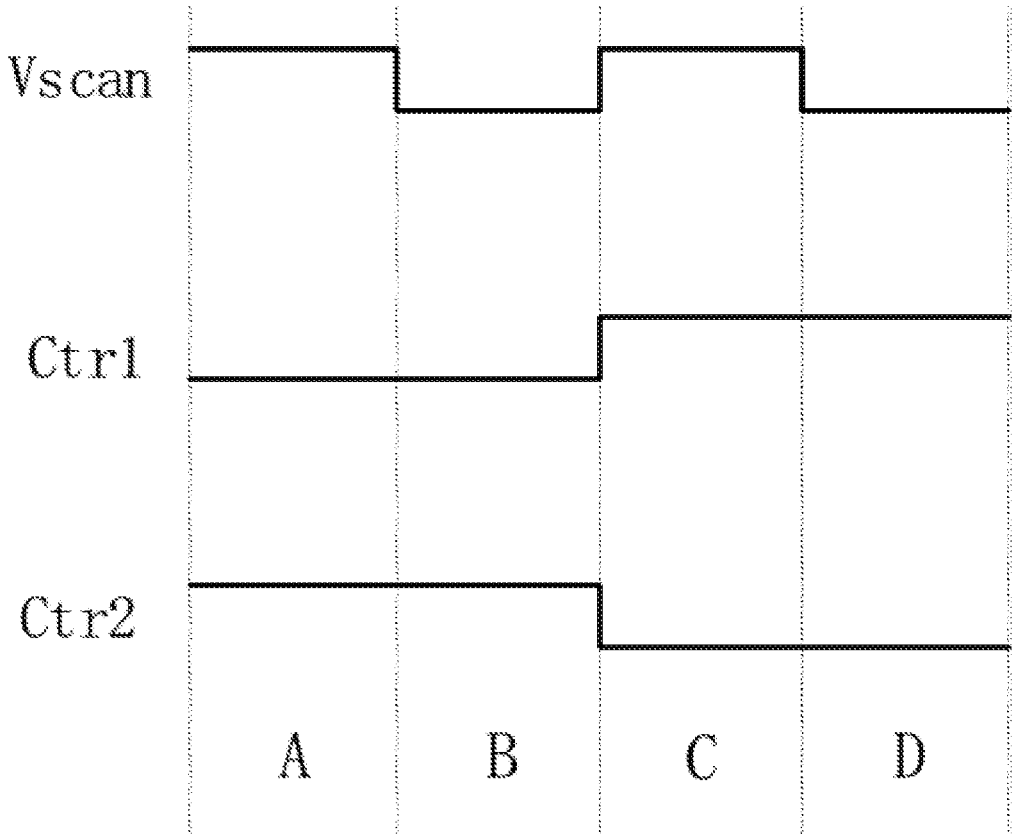
FIG. 2 is a circuit timing diagram of an OLED pixel driving circuit according to an embodiment of the present invention.

FIG. 2 is a circuit timing diagram of an OLED pixel driving circuit according to an embodiment of the present invention, which shows changes in levels of the scan signal Vscan, the first control signal Ctr1, and the second control signal Ctr2 with time. Here, the level is relative. The working process of the pixel driving circuit in this embodiment is divided into four phases: a first storage phase A, a first light-emitting display phase B, a second storage phase C, and a second light-emitting display phase D. The first storage stage A and the first light-emitting display stage B constitute a first frame image. The second storage stage C and the second light-emitting display stage D constitute a second frame image. In a first frame, the first light emitting diode OLED1 emits light, and the second light emitting diode OLED2 is reverse biased. In a second frame, the second light emitting diode OLED2 emits light, and the first light emitting diode OLED1 is reverse biased. The driving control unit, the first control signal, and the second control signal in this embodiment collectively control the first light emitting unit and the second light emitting unit to alternately emit light. Hereinafter, it will be described in detail with reference to FIG. 1 and FIG. 2.

In this implementation scenario, a polarity of a level signal output by the first control signal Ctr1 and a polarity of a level signal output by the second control signal Ctr2 at the same time are opposite. That is, when the first control signal Ctr1 is at a high level, the second control signal Ctr2 is at a low level. When the first control signal Ctr1 is at a low level, the second control signal Ctr2 is at a high level. The timing periods of the first control signal Ctr1 and the second control signal Ctr2 are the display times of two adjacent frames of images. The polarity of the level signal output by the first control signal Ctr1 and the polarity of the level signal output by the second control signal Ctr2 at the same time are only a specific implementation scenario of the present invention. In other implementation scenarios, the level signals of the first control signal Ctr1 and the second control signal Ctr2 may have other relationships. As long as the first light emitting unit and the second light emitting unit can realize alternate light emission, it is within the protection scope of the present invention. A voltage value of the first power source OVDD is higher than the voltage value of the second power source OVSS. For example, the voltage value of the first power source OVDD can be set to a positive voltage, and the voltage value of the second power source OVSS can be set to a negative voltage. Alternatively, the voltage value of the first power source OVDD is set to be a positive voltage, and the voltage value of the second power source OVSS is set to 0 V.

In the first storage phase A, the scan signal Vscan and the second control signal Ctr2 are at a high level, and the first control signal Ctr1 is at a low level. Since the second switch T2 is N-type, the second switch T2 is turned on at this time, and the data signal Vdata is output to a node S1 under control of the scan signal Vscan. At this stage, the storage capacitor Cst is in a charging state, and the first switch T1 is in an off state. The storage capacitor Cst is used to store a level between the node S1 and the first power source OVDD. Since the third switch T3 and the ninth switch T9 are P-type, the third switch T3 and the ninth switch T9 are turned on. The fifth switch T5 and the seventh switch T7 are N-type, so that the fifth switch T5 and the seventh switch T7 are turned off. At this time, the first light emitting diode OLED1 cannot be driven to emit light because the first switch T1 is turned off. Since the fourth switch T4 and the tenth switch T10 are P-type, the fourth switch T4 and the tenth switch T10 are turned off. Since the sixth switch T6 and the eighth switch T8 are N-type, the sixth switch T6 and the eighth switch T8 are turned on. At this time, the eighth switch T8 transmits the level at a node S4 to the anode of the second light emitting diode OLED2. The sixth switch T6 transmits the level at the node S2 to the cathode of the second light emitting diode OLED2, so that the second light emitting diode OLED2 is in a reverse bias state. At this stage, the storage of the level between the node S1 and the first power source OVDD is mainly completed through the storage capacitor Cst. That is, the storage phase of the data signal Vdata of the first light emitting diode OLED1.

In the first light-emitting display stage B, the scan signal Vscan and the first control signal Ctr1 are at a low level, and the second control signal Ctr2 is at a high level. At this time, the second switch T2 is turned off and the first switch T1 is turned on. Since the third switch T3 and the ninth switch T9 are P-type, the third switch T3 and the ninth switch T9 are turned on. The fifth switch T5 and the seventh switch T7 are N-type, so that the fifth switch T5 and the seventh switch T7 are turned off. At this time, the first power source OVDD, the first switch T1, the third switch T3, the first light emitting diode OLED1, the ninth switch T9, and the second power source OVSS form a path, and the first light emitting diode OLED1 emits light. Since the fourth switch T4 and the tenth switch T10 are P-type, the fourth switch T4 and the tenth switch T10 are turned off. Since the sixth switch T6 and the eighth switch T8 are N-type, the sixth switch T6 and the eighth switch T8 are turned on. At this time, the second light emitting diode OLED2 and the first storage stage A continue to be in a reverse biased state. That is, this stage is a light-emitting display stage of the first light emitting diode OLED1.

In the second storage phase C, the scan signal Vscan and the first control signal Ctr1 are at a high level, and the second control signal Ctr2 is at a low level. Since the second switch T2 is N-type, the second switch T2 is turned on at this time, and the data signal Vdata is output to the node S1 under the control of the scan signal Vscan. At this stage, the storage capacitor Cst is in a charging state, the first switch T1 is in an off state, and the storage capacitor Cst is used to store a level between the node S1 and the first power source OVDD. Since the fourth switch T4 and the tenth switch T10 are P-type, the fourth switch T4 and the tenth switch T10 are turned on. The sixth switch T6 and the eighth switch T8 are N-type, so that the sixth switch T6 and the eighth switch T8 are turned off. At this time, the second light emitting diode OLED2 cannot be driven to emit light because the first switch T1 is turned off. Since the third switch T3 and the ninth switch T9 are P-type, the third switch T3 and the ninth switch T9 are turned off. Since the fifth switch T5 and the seventh switch T7 are N-type, the fifth switch T5 and the seventh switch T7 are turned on. At this time, the seventh switch T7 transmits the level at the node S3 to the anode of the first light emitting diode OLED1. The fifth switch T5 transmits the level at the node S2 to the cathode of the first light emitting diode OLED1, so that the first light emitting diode OLED1 is in a reverse biased state. As in the first storage stage A, the storage of the level between the node S1 and the first power source OVDD is mainly completed by the storage capacitor Cst in this stage. That is, the storage phase of the data signal Vdata of the second light emitting diode OLED2.

In the second light-emitting display stage D, the scan signal Vscan and the second control signal Ctr2 are at a low level and the first control signal Ctr1 is at a high level. At this time, the second switch T2 is turned off and the first switch T1 is turned on. Since the fourth switch T4 and the tenth switch T10 are P-type, the fourth switch T4 and the tenth switch T10 are turned on. The sixth switch T6 and the eighth switch T8 are N-type, so that the sixth switch T6 and the eighth switch T8 are turned off. At this time, the first power source OVDD, the first switch T1, the fourth switch T4, the second light emitting diode OLED2, the tenth switch T10, and the second power source OVSS form a path, and the second light emitting diode OLED2 emits light. Since the third switch T3 and the ninth switch T9 are P-type, the third switch T3 and the ninth switch T9 are turned off. Since the fifth switch T5 and the seventh switch T7 are N-type, the fifth switch T5 and the seventh switch T7 are turned on. At this time, the first light emitting diode OLED1 continues to be in a reverse-biased state like the second storage stage C. That is, this stage is a light-emitting display stage of the second light emitting diode OLED2.

It can be known from the above four stages that an embodiment of the present invention makes two OLEDs alternately emit light by sharing a driving thin film transistor, a storage capacitor, and a data line with the two OLEDs. In this way, the light emitting time of the OLEDs is reduced, the number of parasitic capacitors and data lines in a panel is reduced, and the aperture ratio of the OLED device is increased; and the OLEDs are enabled to be in reverse bias in a non-light emitting display frame, so that the OLEDs do not have to be in a DC bias state for a long time, and thus, the aging of the OLED device is slowed down. In addition, no other reverse bias voltage is connected externally, so the difficulty of tracing of the pixel circuit and the crosstalk from a bias voltage line to other signal lines are reduced.

Figure 3:
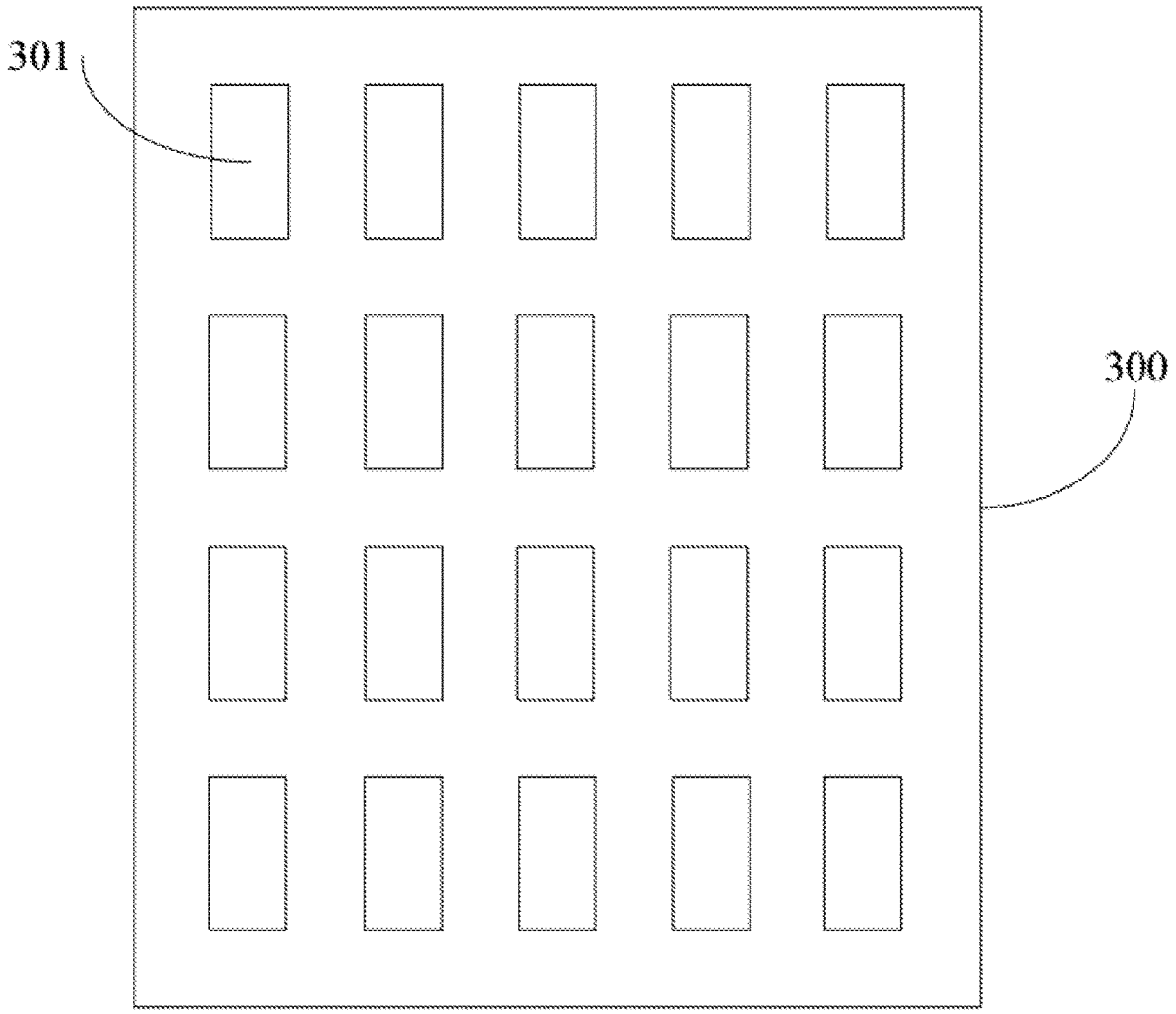
FIG. 3 is a schematic structural diagram of an OLED array substrate according to an embodiment of the present invention.

FIG. 3 is a schematic structural diagram of an OLED array substrate according to an embodiment of the present invention. The array substrate 300 includes a plurality of OLED pixel units 301 arranged in an array. Each OLED pixel unit 301 includes a pixel driving circuit as described above.

An embodiment of the present invention also provides an OLED display device. The display device is provided with the OLED array substrate. The array substrate includes a plurality of OLED pixel units arranged in an array. Each OLED pixel unit includes a pixel driving circuit as described above. The OLED display device may specifically be a product with a display function such as a mobile phone, a tablet computer, a television, a display, a digital camera, and the like.

Different from the situation of the prior art, the present invention allows two OLEDs to share a driving thin film transistor, a storage capacitor, and a data line, so that the two OLEDs alternately emit light. In this way, the light emitting time of the OLEDs is reduced, the number of parasitic capacitors and data lines in a panel is reduced, and the aperture ratio of the OLED device is increased; and the OLEDs are enabled to be in reverse bias in a non-light emitting display frame, so that the OLEDs do not have to be in a DC bias state for a long time, and thus, the aging of the OLED device is slowed down. In addition, no other reverse bias voltage is connected externally, so the difficulty of tracing of the pixel circuit and the crosstalk from a bias voltage line to other signal lines are reduced.

Obviously, those skilled in the art can make various modifications and variations to the present invention without departing from the spirit and scope of the present invention. In this way, if these modifications and variations of the present invention fall within the scope of the claims of the present invention and their equivalent technologies, the present invention also intends to include these modifications and variations.

What is claimed is:

1. An organic light emitting diode (OLED) pixel driving circuit, comprising:

a driving control unit; a first light emitting unit; and a second light emitting unit;

wherein the driving control unit comprises a first switch, a second switch, and a storage capacitor; a control end of the second switch is connected to a scan line, a drain of the second switch is connected to a data line, a source of the second switch is connected to an end of the storage capacitor and a control end of the first switch, and another end of the storage capacitor and a drain of the first switch are connected to a first power source;

wherein a source of the first switch is connected to the first light emitting unit and the second light emitting unit, the first light emitting unit and the second light emitting unit are connected to a second power source, a control end of the first light emitting unit is connected to a first control signal, a control end of the second light emitting unit is connected to a second control signal, and the driving control unit, the first control signal, and the second control signal control the first light emitting unit and the second light emitting unit to alternately emit light.

2. The OLED pixel driving circuit according to claim 1, wherein a polarity of a level signal output by the first control signal and a polarity of a level signal output by the second control signal at the same time are opposite.

3. The OLED pixel driving circuit according to claim 1, wherein the first light emitting unit comprises a third switch, a fifth switch, a seventh switch, a ninth switch, and a first light emitting diode, an anode of the first light emitting diode is connected to a drain of the third switch and a drain of the seventh switch, a cathode of the first light emitting diode is connected to a source of the ninth switch and a source of the fifth switch, a drain of the fifth switch is connected to the first power source, and a source of the seventh switch and a drain of the ninth switch are connected to the second power source.

4. The OLED pixel driving circuit according to claim 3, wherein the second light emitting unit comprises a fourth switch, a sixth switch, an eighth switch, a tenth switch, and a second light emitting diode, an anode of the second light emitting diode is connected to a drain of the fourth switch and a drain of the eighth switch, a cathode of the second light emitting diode is connected to a source of the tenth switch and a source of the sixth switch, a drain of the sixth switch is connected to the first power source, and a source of the eighth switch and a drain of the tenth switch are connected to the second power source.

5. The OLED pixel driving circuit according to claim 4, wherein the first switch, the second switch, the fifth switch, the sixth switch, the seventh switch, and the eighth switch are N-type transistor switches, and the third switch, the fourth switch, the ninth switch, and the tenth switch are P-type transistor switches.

6. The OLED pixel driving circuit according to claim 4, wherein when the first light emitting diode emits light, the second light emitting diode is reverse biased; when the second light emitting diode emits light, the first light emitting diode is reverse biased.

7. The OLED pixel driving circuit according to claim 1, wherein a voltage value of the first power source is higher than a voltage value of the second power source.

8. The OLED pixel driving circuit according to claim 1, wherein a timing period of the first control signal and a timing period of the second control signal are display times of two adjacent frames of image.

9. An OLED array substrate, comprising:

a pixel driving circuit comprising a driving control unit; a first light emitting unit; and a second light emitting unit;

wherein the driving control unit comprises a first switch, a second switch, and a storage capacitor; a control end of the second switch is connected to a scan line, a drain of the second switch is connected to a data line, a source of the second switch is connected to an end of the storage capacitor and a control end of the first switch, and another end of the storage capacitor and a drain of the first switch are connected to a first power source;

wherein a source of the first switch is connected to the first light emitting unit and the second light emitting unit, the first light emitting unit and the second light emitting unit are connected to a second power source, a control end of the first light emitting unit is connected to a first control signal, a control end of the second light emitting unit is connected to a second control signal, and the driving control unit, the first control signal, and the second control signal control the first light emitting unit and the second light emitting unit to alternately emit light.

10. The OLED array substrate according to claim 9, wherein a polarity of a level signal output by the first control signal and a polarity of a level signal output by the second control signal at the same time are opposite.

11. The OLED array substrate according to claim 9, wherein the first light emitting unit comprises a third switch, a fifth switch, a seventh switch, a ninth switch, and a first light emitting diode, an anode of the first light emitting diode is connected to a drain of the third switch and a drain of the seventh switch, a cathode of the first light emitting diode is connected to a source of the ninth switch and a source of the fifth switch, a drain of the fifth switch is connected to the first power source, and a source of the seventh switch and a drain of the ninth switch are connected to the second power source.

12. The OLED array substrate according to claim 11, wherein the second light emitting unit comprises a fourth switch, a sixth switch, an eighth switch, a tenth switch, and a second light emitting diode, an anode of the second light emitting diode is connected to a drain of the fourth switch and a drain of the eighth switch, a cathode of the second light emitting diode is connected to a source of the tenth switch and a source of the sixth switch, a drain of the sixth switch is connected to the first power source, and a source of the eighth switch and a drain of the tenth switch are connected to the second power source.

13. The OLED array substrate according to claim 12, wherein the first switch, the second switch, the fifth switch, the sixth switch, the seventh switch, and the eighth switch are N-type transistor switches, and the third switch, the fourth switch, the ninth switch, and the tenth switch are P-type transistor switches.

14. The OLED array substrate according to claim 12, wherein when the first light emitting diode emits light, the second light emitting diode is reverse biased; when the second light emitting diode emits light, the first light emitting diode is reverse biased.

15. An OLED display device, comprising:

an OLED array substrate comprising a pixel driving circuit, wherein the pixel driving circuit comprises a driving control unit; a first light emitting unit; and a second light emitting unit;

wherein the driving control unit comprises a first switch, a second switch, and a storage capacitor; a control end of the second switch is connected to a scan line, a drain of the second switch is connected to a data line, a source of the second switch is connected to an end of the storage capacitor and a control end of the first switch, and another end of the storage capacitor and a drain of the first switch are connected to a first power source;

wherein a source of the first switch is connected to the first light emitting unit and the second light emitting unit, the first light emitting unit and the second light emitting unit are connected to a second power source, a control end of the first light emitting unit is connected to a first control signal, a control end of the second light emitting unit is connected to a second control signal, and the driving control unit, the first control signal, and the second control signal control the first light emitting unit and the second light emitting unit to alternately emit light.

16. The OLED display device according to claim 15, wherein a polarity of a level signal output by the first control signal and a polarity of a level signal output by the second control signal at the same time are opposite.

17. The OLED display device according to claim 15, wherein the first light emitting unit comprises a third switch, a fifth switch, a seventh switch, a ninth switch, and a first light emitting diode, an anode of the first light emitting diode is connected to a drain of the third switch and a drain of the seventh switch, a cathode of the first light emitting diode is connected to a source of the ninth switch and a source of the fifth switch, a drain of the fifth switch is connected to the first power source, and a source of the seventh switch and a drain of the ninth switch are connected to the second power source.

18. The OLED display device according to claim 17, wherein the second light emitting unit comprises a fourth switch, a sixth switch, an eighth switch, a tenth switch, and a second light emitting diode, an anode of the second light emitting diode is connected to a drain of the fourth switch and a drain of the eighth switch, a cathode of the second light emitting diode is connected to a source of the tenth switch and a source of the sixth switch, a drain of the sixth switch is connected to the first power source, and a source of the eighth switch and a drain of the tenth switch are connected to the second power source.

19. The OLED display device according to claim 18, wherein the first switch, the second switch, the fifth switch, the sixth switch, the seventh switch, and the eighth switch are N-type transistor switches, and the third switch, the fourth switch, the ninth switch, and the tenth switch are P-type transistor switches.

20. The OLED display device according to claim 18, wherein when the first light emitting diode emits light, the second light emitting diode is reverse biased; when the second light emitting diode emits light, the first light emitting diode is reverse biased.

* * * * *